US006367228B1

(12) United States Patent
Wurst et al.

(10) Patent No.: US 6,367,228 B1
(45) Date of Patent: Apr. 9, 2002

(54) CAPSULE PART CARRIER IN A FILLING AND SEALING MACHINE FOR TWO-PART CAPSULES

(75) Inventors: Reiner Wurst, Auenwald; Manfred Kuhnle, Schwaikheim, both of (DE)

(73) Assignee: Robert Bosch GmbH, Stuttgart ( * ) Notice: Subject to any disclaimer, the term of this patent is extended or adjusted under 35 U.S.C. 154(b) by 0 days.

(21) Appl. No.: 09/523,952

(22) Filed: Mar. 13, 2000

(30) Foreign Application Priority Data

Mar. 13, 1999 (DE) ..... 199 11 276
May 14, 1999 (DE) ..... 199 22 228

(51) Int. Cl.[7] ..... B65B 43/26; B65B 43/30

(52) U.S. Cl. ..... 53/381.4; 53/53; 53/281; 53/505

(58) Field of Search ..... 53/53, 109, 281, 53/281.4, 282, 381 A, 505, 506, 900, 468, 471

(56) References Cited

U.S. PATENT DOCUMENTS 4,403,461 A 9/1983 Goutard et al. ..... 53/282
4,615,165 A * 10/1986 Gamberini ..... 53/282
4,627,225 A * 12/1986 Faller et al. ..... 53/510
4,667,455 A * 5/1987 Morrow ..... 53/471
4,964,262 A * 10/1990 Moser et al. ..... 53/506
5,417,030 A * 5/1995 Ribani et al. ..... 53/281
5,617,710 A * 4/1997 Goossens et al. ..... 53/471

FOREIGN PATENT DOCUMENTS

DE 31 07 627 A1 1/1982
DE 38 30 013 C2 3/1990

* cited by examiner

*Primary Examiner*—Peter Vo
*Assistant Examiner*—Hemant M Desai
(74) *Attorney, Agent, or Firm*—Ronald E. Greigg

(57) ABSTRACT

A capsule part carrier in a filling and sealing machine for two-part capsules comprises a lower segment for capsule bottom parts and an upper segment for caps. In each of the segments, two stepped bores embodied of bore portions are provided, which form a seat for the capsule bottom part and the cap. In the bore portions of the lower segment, a plurality of longitudinal grooves are formed, which communicate via a suction bore with a vacuum source. Via the longitudinal grooves, the negative pressure applied in the lower segment can also act on the upper segment and the cap. Instead of longitudinal grooves, separate through bores can also be provided, which communicate with the suction bore.

8 Claims, 3 Drawing Sheets

FIG. 6
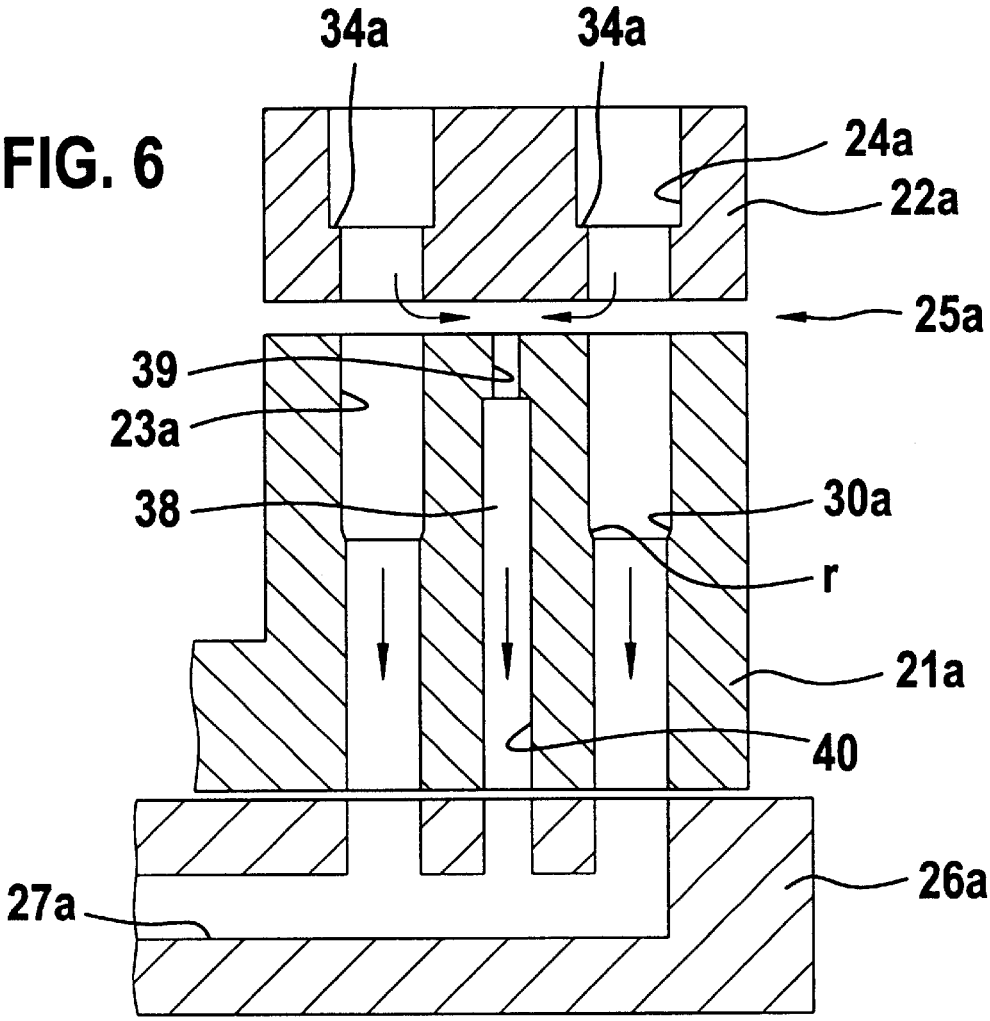
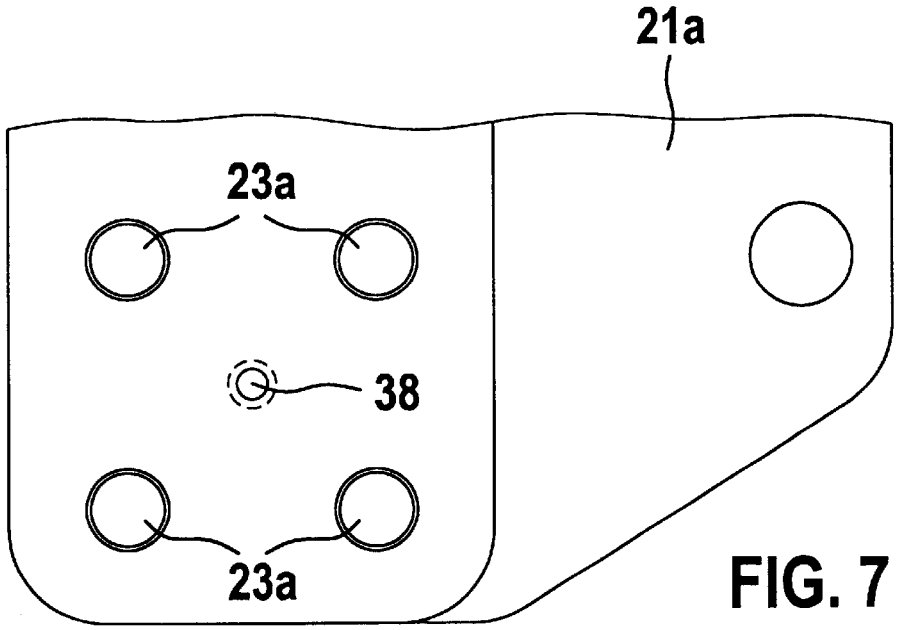
FIG. 7

CAPSULE PART CARRIER IN A FILLING AND SEALING MACHINE FOR TWO-PART CAPSULES

BACKGROUND OF THE INVENTION

The invention relates to a capsule part carrier in a filling and sealing machine for two-part capsules. Such capsule part carriers are used in filling and sealing machines, of the kind known from German patent DE 38 20 013 C2, in order to separate the empty capsules, kept on hand, into their capsule bottom parts and capsule top parts, which are then put together again once the capsule bottom parts have been filled. When certain capsule formats and qualities are being handled, it has been found that capsule bottom parts, after they have been separated from the capsule top parts by means of negative pressure and meet their seats in the stepped bores of the lower segments, sometimes bounce back out of the lower segment, causing the associated capsule top part to spin out of the upper segment. This effect can be explained by the fact that the capsule bottom parts are pinched in the region of the seats by striking the seats of the stepped bores of the lower segments. It can then happen that the tension suddenly breaks, and the capsule bottom parts bounce out of their seats. Particularly if a capsule top part has been spun out of its upper segment, the applicable capsule can no longer be sealed or processed. In an extreme case, this can even lead to an interruption in operation.

OBJECT AND SUMMARY OF THE INVENTION

The capsule part carrier of the invention in a filling and sealing machine for two-part capsules has the advantage over the prior art that the capsule top parts are pulled out of the lower segments into their seats by the negative pressure acting on them, thus preventing the capsule top parts from being spun out of the upper segments.

Further advantageous features of the capsule part carrier of the invention are defined hereinafter.

When so-called pellets or sticky products are being handled, it has proved to be especially advantageous for the additional recesses to be embodied as separate through bores. These through bores are very simple to produce and in the case of the products in question, they have the advantage that no product can stick in the stepped bores of the lower segments and thus make it more difficult or impossible to insert capsule bottom parts.

Embodying the through bores as stepped bores improves the effect of aspirating the capsule top parts by increasing the flow velocity on the side toward the capsule top parts.

To distribute the suction action for the capsule top parts uniformly to all the capsule top parts in the upper segment, the through bore is preferably disposed at the same spacing from the stepped bores, associated with the through bore of the capsule bottom parts or capsule top parts.

In a further embodiment of the invention, the additional recesses are realized in the form of longitudinal grooves embodied in the wall of the stepped bore for the lower capsule parts. As a result, the tendency of the capsule bottom parts to become pinched on the seats of the lower segments can also at least be lessened. If nevertheless a capsule bottom part should bounce out because of being pinched, then it is assured that the associated capsule top part will not be spun out of the upper segment. This is attained on the one hand because the contact area of the capsule bottom parts on the seats of the lower segments is reduced, and on the other because the negative pressure, which causes the separation of the capsule bottom parts from the capsule top parts, now also acts directly on the capsule top parts, so that the capsule top parts are pulled onto their seats in the upper segments.

The invention will be better understood and further objects and advantages thereof will become more apparent from the ensuing detailed description of preferred embodiments taken in conjunction with the drawings.

BRIEF DESCRIPTION OF THE DRAWINGS

FIG. 6 is a section through part of a modified separating station; and

FIG. 7 is a plan view on a lower part segment of FIG. 6.

DESCRIPTION OF THE PREFERRED EMBODIMENTS

Figure 1:
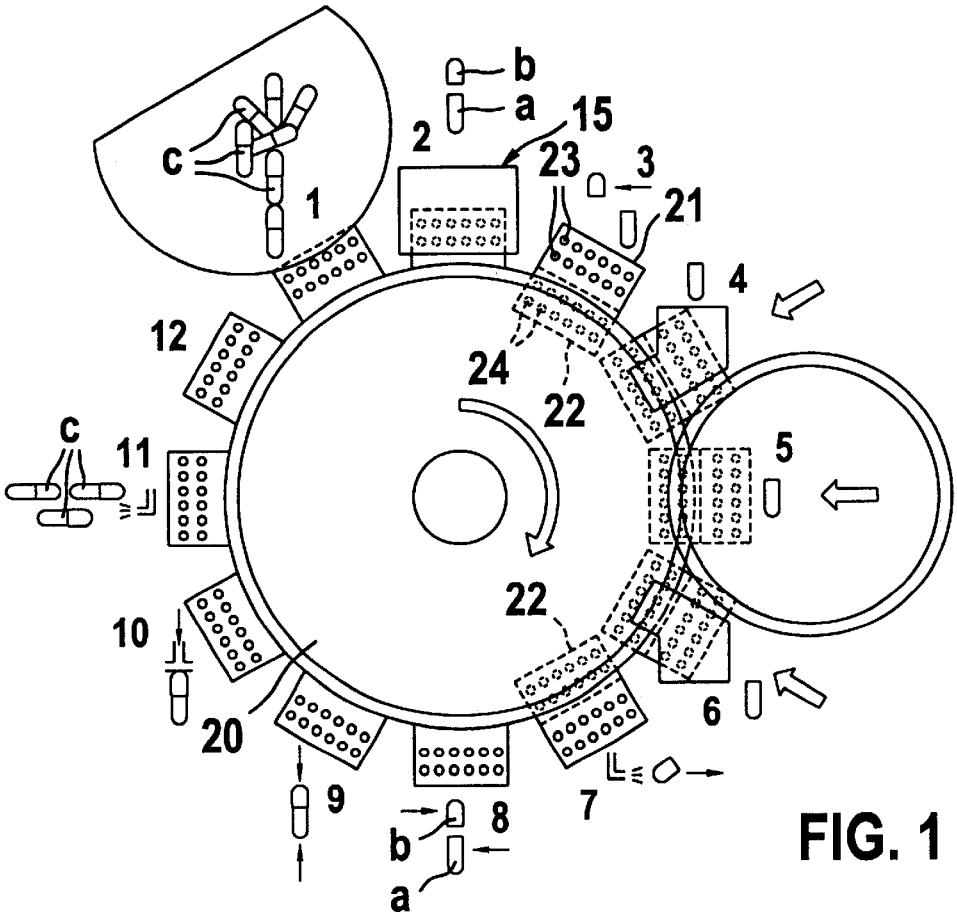
FIG. 1 shows a capsule filling and sealing machine in a simplified plan view.

A machine for filling and sealing capsules c made up of a capsule bottom part a and a cap b mounted on the capsule has a 12-piece feed wheel 20, rotated in increments about a vertical axis, at the stations 1–12 of which along the path of revolution the individual handling devices are arranged. At station 1, the empty capsules c to be filled are placed in random order and then delivered straightened and in order to the feed wheel 20. At station 2, the caps b are then separated from the capsule bottom parts a, and both parts are checked by a checking device 15 for their presence and intactness. At station 3, the caps b are put out of coincidence with the capsule bottom parts a, so that at stations 4, 5 and 6 a product can be placed in the capsule bottom parts a. At station 7, any capsule bottom parts a and caps b that have been found defective are expelled. At station 8, the caps b are pushed back into coincidence with the capsule bottom parts a, and at stations 9 and 10 they are put back together with the capsule bottom parts a. At station 11, the correctly filled, sealed capsules c are expelled and carried away. Finally, in station 12, the recesses of the feed wheel 20 are cleaned before being refilled with empty capsules again at station 1.

On the circumference of the incrementally rotated feed wheel 20, twelve segments 21 for capsule bottom parts a are secured at equal angular intervals. Other segments 22 for the caps b are also disposed on the feed wheel 20, above the segments 21, in such a way that they can be both raised and lowered and radially displaced. The lower segments 21 have vertically oriented stepped bores 23 for the capsule bottom parts a, and the upper segments 22 likewise have vertically oriented stepped bores 24 for the caps b. The stepped bores 23 and 24 are disposed in coincidence in the segments 21, 22, for instance in two rows of six bores each.

The machine described thus far is widely known and can be modified in manifold ways to meat specific requirements. What is essential to the invention is the embodiment of the capsule part carriers 25, which each comprise one lower segment 21 and one upper segment 22, and which can be secured on the feed wheel 20 interchangeably so that various capsule formats can be handled.

Figure 2:
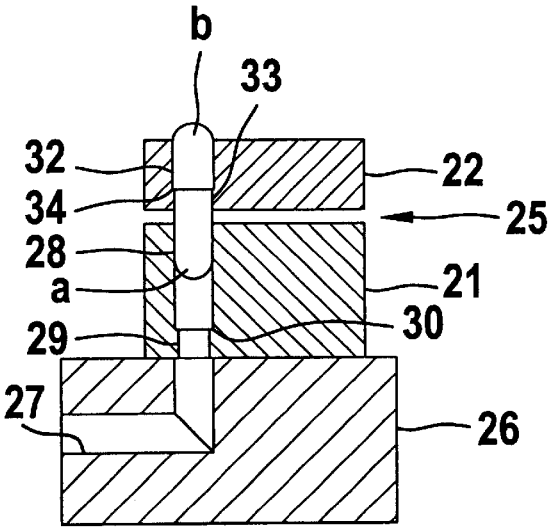
FIGS. 2 and 3 show simplified sections through part of a separating station during various phases in operation.
Figure 3:
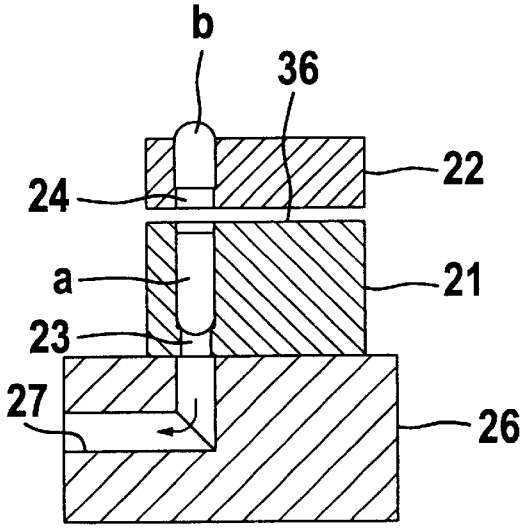

As seen from FIGS. 2 and 3, the two segments 21, 22 in the region of the separating station 2 are disposed in coincidence and spaced slightly apart one above the other and above a suction plate 26. The suction plate 26 has one suction bore 27 for each of the stepped bores 23, 24, and the suction bore communicates with a vacuum source, not shown, and the one opening of the suction bore is aligned with the lower stepped bore 23. The lower stepped bores 23 each have two bore portions 28, 29. One bore portion 28 has a diameter adapted to the diameter of the capsule bottom part a, while the bore portion 29 has a lesser diameter. As a consequence, in the transition region of the two bore portions 28, 29, a seat 30 for a capsule bottom part a is formed. As can be seen from FIG. 5, the seat 30 has a radius r adapted to the shape of the capsule. For further reduction of the tendency of the capsule bottom parts a to become pinched or damaged, a conical seat can also be preferably embodied instead of the radius r. The upper stepped bores 24 have two bore portions 32, 33. One bore portion 32 has a diameter adapted to that of the cap b, while the bore portion 33 has a lesser diameter adapted to the capsule bottom part a. Once again, a seat 34 is formed between the two bore portions 32, 33; it serves here to restrain the cap b.

As seen from FIG. 2, the capsules c are delivered to the separating station 2 with the capsule bottom part a pointing downward, so that the cap b is seated on the seat 34, and the capsule bottom part a protrudes out of the upper segment 22 into the bore portion 28 of the lower segment 21. If a vacuum is now applied via the suction bore 27 as indicated in FIG. 3, the capsule bottom part a is removed from the cap b and pulled onto the seat 30, and as a result the two capsule parts are separated from one another and can be delivered to subsequent handling stations.

Figure 4:
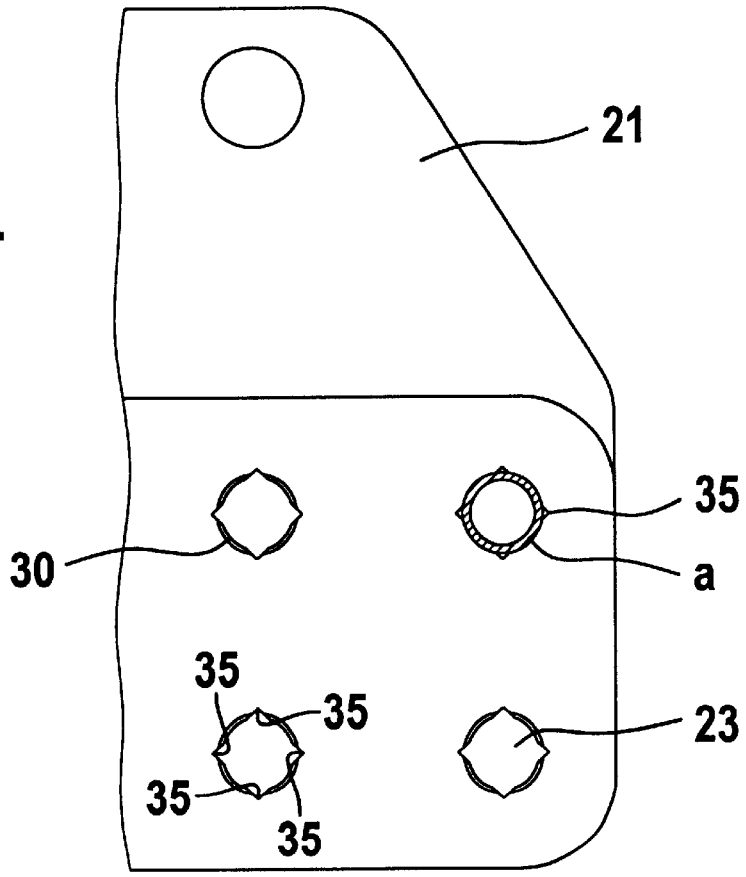
FIG. 4 is a plan view on part of a lower part segment.
Figure 5:
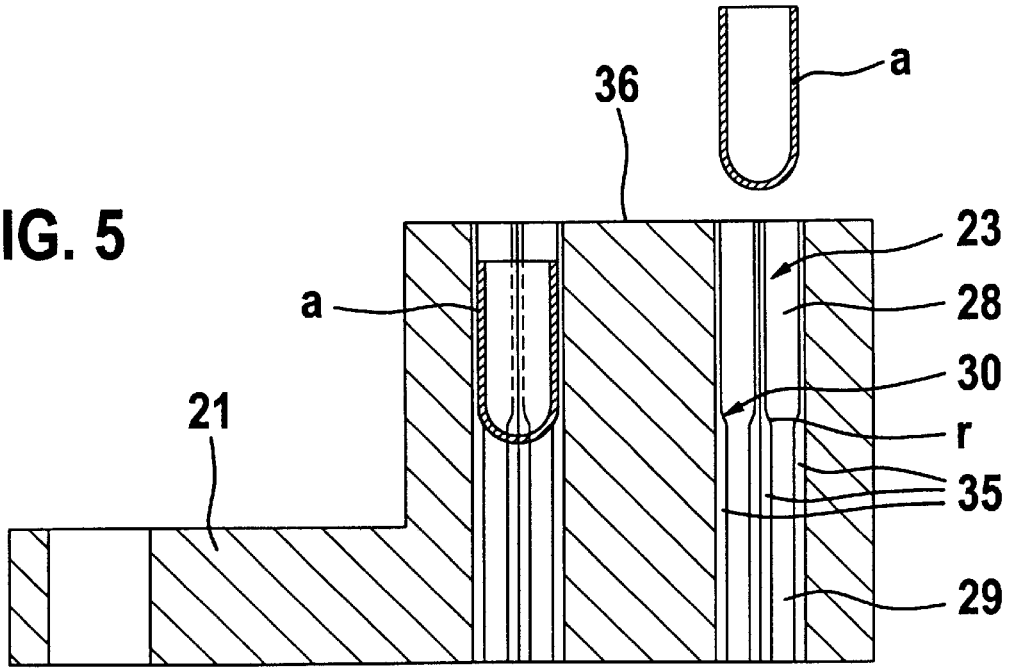
FIG. 5 is a section through a lower part segment.

To prevent the capsule bottom parts a from bouncing out of the lower segments 21, or to avert the consequences thereof, the lower segment 21 is embodied in a special way, for which reference will be made to FIGS. 4 and 5. It can be seen from these Figures that in the two bore portions 28, 29, there are four additional longitudinal grooves 35 disposed at equal angular intervals. The longitudinal grooves 35 in the bore portions 28, 29 are preferably formed by reaming, and the reaming tool has a square cross section. Because of the different diameters of the two bore portions 28, 29, different depths of the longitudinal grooves 35 result; in the bore portion 29, the longitudinal grooves 35 have a greater depth than in the bore portion 28. What is essential is that by means of the longitudinal grooves 35, regardless of the position of the capsule bottom part a, a continuous communication between the suction bore 27 and the top side 36 of the lower segment 21 is always formed. The contact area of the seat 30 for the capsule bottom part a is also reduced by the longitudinal grooves 35.

If a capsule bottom part a upon application of the vacuum is now pulled against the suction bore 27 in the direction of the seat 30, then there is a simultaneous flow around the circumference of the capsule bottom part a via the longitudinal grooves 35, so that a negative pressure also prevails on the top side 36 of the lower segment 21 in the region of the longitudinal grooves 35. Once the capsule bottom part a has been separated from the cap 5, the result of this is that via the longitudinal grooves 35, the negative pressure prevailing in the capsule 3 as a result of the separation is vented via the longitudinal grooves 35, and at the same time the cap b is pulled additionally onto its seat 34 by the negative pressure. If despite the fact that the contact area of the seat 34 has been reduced by the longitudinal grooves 35 a rebounding of the capsule bottom part a into the upper segment 22 occurs, then the cap b is prevented from being spun out of the upper segment 22 by the negative pressure that pulls the cap b onto its seat 34.

The above-described capsule part carrier 25 can be modified in manifold ways without departing from the concept of the invention. For instance, it is conceivable in particular to use a different number of longitudinal grooves 35 or a different longitudinal groove geometry; in the final analysis, both of these factors will be determined in an individual case by the production options and functional considerations. It is also conceivable to embody the longitudinal grooves not rectilinearly but instead in the form of spirals or extending obliquely, for instance. Finally, it would also be possible to provide longitudinal grooves in the upper segment 22. If these longitudinal grooves are acted upon by compressed air from the top side of the upper segment 22, then the described effect may possibly be enhanced still further.

In the second exemplary embodiment of the invention shown in FIGS. 6 and 7, with the capsule part carriers 25*a*, the lower stepped bores 23*a* of the lower segments 21*a* have no longitudinal grooves 35; instead, they have additional suction bores 38 in alignment with the lower stepped bores 23*a* and spaced apart from them. The additional suction bores 38 are embodied as through and stepped bores. The additional suction bores 38 have a first portion 39 of lesser diameter and relatively short length oriented toward the respective upper segment 23*a*, and a portion 40 of larger diameter and relatively greater length oriented toward the suction plate 26*a*. The portion 40 communicates with the suction bore 27*a* of the suction plate 26*a*. In the example shown in FIG. 7, one additional suction bore 38 each is disposed between four stepped bores 23*a*, so that the stepped bores each have the same spacing from the additional suction bore 38. As seen from FIG. 6, the effect of the suction bores 38, if they are in coincidence with their suction plate 26*a*, is that a negative pressure occurs in the suction bores 38 that acts in particular on the stepped bores 24*a* of the upper segment 22*a* as well and pulls the capsule top parts b located in the stepped bores 24*a* onto their seat 34*a*.

The capsule part carrier 25*a* can be modified in manifold ways as well: For instance, each stepped bore 23*a* can be assigned its own additional suction bore, which is disposed spaced slightly apart from the stepped bore 23*a*. The first portion 39 can also be embodied in the form of a plurality of recesses or obliquely disposed bores, so that a lesser spacing occurs between the additional suction bore 38 and the associated stepped bores 23*a*. The seats 30*a* in the lower segment 21*a* can also each have a conically embodied seat instead of the radius r, as in the first exemplary embodiment.

The foregoing relates to preferred exemplary embodiments of the invention, it being understood that other variants and embodiments thereof are possible within the spirit and scope of the invention, the latter being defined by the appended claims.

We claim:

1. A capsule part carrier (25; 25*a*) in a filling and sealing machine for two-part capsules (c), comprising a first segment (21; 21*a*) for receiving capsule bottom parts (a) and a second segment (22, 22*a*) for receiving capsule top parts (b), and stepped bores (23; 23*a*, 24; 24*a*) for receiving the capsule bottom parts (a) and the capsule top parts (b) are embodied in the segments (21; 21*a*, 22; 22*a*), and the stepped bores (23; 23*a*, 24; 24*a*) are brought into coincidence in order to separate the capsule parts from one another and cooperate with vacuum suction bores (27; 27*a*), to separate the capsule parts the stepped bores are disposed in operative connection with the first segment (21; 21*a*) in order to aspirate the capsule bottom parts (a) into the stepped bores (23; 23*a*) of the first segments (21; 21*a*), at least one additional recess is embodied in the stepped bore (23; 23*a*) of the first segment (21; 21*a*), said at least one additional recess is embodied as a separate through bore (38) in the first segment (21*a*), said recess transmits a negative pressure, prevailing in the vacuum suction bore (27; 27*a*), to the stepped bores (24; 24*a*) of the second segments (22; 22*a*), bypassing the capsule bottom parts (a).

2. The capsule part carrier according to claim 1, in which the separate through bore (38) is embodied as a stepped bore, and a portion (39) having a lesser diameter is disposed on a side of the first segment (21*a*) oriented toward the segment (22*a*).

3. The capsule part carrier according to claim 2, in which the separate through bore (38) has the same spacing in each case from the stepped bores (23*a*), associated with the through bore of the first segment (21*a*).

4. The capsule part carrier according to claim 1, in which the separate through bore (38) has the same spacing in each case from the stepped bores (23*a*), associated with the through bore of the first segment (21*a*).

5. A filling and sealing machine having capsule part carriers (25; 25*a*) according to claim 1.

6. A capsule part carrier (25; 25*a*) in a filling and sealing machine. for two-part capsules (c), comprising a first segment (21; 21*a*) for receiving capsule bottom parts (a) and a second segment (22, 22*a*) for receiving capsule top parts (b), and stepped bores (23; 23*a*, 24; 24*a*) for receiving the capsule bottom parts (a) and the capsule top parts (b) are embodied in the segments (21; 21*a*, 22; 22*a*), and the stepped bores (23; 23*a*, 24; 24*a*) are brought into coincidence in order to separate the capsule parts from one another and cooperate with vacuum suction bores (27; 27*a*), to separate the capsule parts the stepped bores are disposed in operative connection with the first segment (21; 21*a*) in order to aspirate the capsule bottom parts (a) into the stepped bores (23; 23*a*) of the first segments (21; 21*a*), at least one additional recess is embodied in the stepped bore (23; 23*a*) of the first segment (21; 21*a*), said at least one additional recess is embodied as a longitudinal groove (35), disposed in a wall of the stepped bore (23), with an orientation parallel to the stepped bores 23, said recess transmits a negative pressure, prevailing in the vacuum suction bore (27; 27*a*), to the stepped bores (24; 24*a*) of the second segments (22; 22*a*), bypassing the capsule bottom parts (a).

7. The capsule part carrier according to claim 6, in which a plurality of longitudinal grooves (35) are disposed at uniform angular spacings on the wall of the stepped bore (23).

8. A filling and sealing machine having capsule part carriers (25; 25*a*) according to claim 6.

* * * * *